US005408773A

United States Patent [19]

Hwang

[11] Patent Number: 5,408,773

[45] Date of Patent: Apr. 25, 1995

[54] HOUSE NUMBER PLATE AND LAMP ASSEMBLY

[76] Inventor: Steven Hwang, 4F, No. 6-6, Alley 11, Lane 147, Sec. 3 Hsin Yi Road, Taipei, Taiwan, Prov. of China

[21] Appl. No.: 207,190

[22] Filed: Mar. 8, 1994

[51] Int. Cl.[6] ..... G09F 13/09

[52] U.S. Cl. ..... 40/547; 40/576

[58] Field of Search ..... 40/564, 575, 576, 582, 40/547, 550, 553; 362/806

[56] References Cited

U.S. PATENT DOCUMENTS

| | | | |
|---|---|---|---|
| 1,568,630 | 1/1926 | Shearer | 40/576 |
| 2,798,323 | 7/1957 | Witz | 40/576 |
| 4,279,089 | 7/1981 | Murakami | 40/547 |
| 4,765,080 | 8/1988 | Conti | 40/576 |
| 4,854,062 | 8/1989 | Bayo | 40/576 |
| 4,901,461 | 2/1990 | Edwards et al. | 40/553 |
| 5,040,320 | 8/1991 | Reidinger | 40/547 |

*Primary Examiner*—Kenneth J. Corner

*Assistant Examiner*—James O. Hansen

*Attorney, Agent, or Firm*—Jacobson, Price, Holman & Stern

[57] ABSTRACT

A house number plate and lamp assembly includes a housing having an opening; a window plate fastened inside the housing behind the opening and having a plurality of view windows; a plurality of number plates fastened to either view window, each number plate having a plurality of small through holes made around the border of a white-colored numeral being printed on a black-colored front surface thereof, a holder frame on a back surface thereof, a light emitting device mounted on the holder frame at the top, a plurality of optical fiber tubes fastened to the holder frame at the bottom and respectively inserted in either small through hole; and an electric circuit board fastened inside the housing and controlled to provide power supply to the light emitting device on each number plate causing it to send light through the optical fiber tubes in illuminating the numeral.

2 Claims, 3 Drawing Sheets

HOUSE NUMBER PLATE AND LAMP ASSEMBLY

BACKGROUND OF THE INVENTION

The present invention relates to a house number plate and lamp assembly which comprises a plurality of number plates fastened inside the housing thereof behind a window plate to hold a light emitting device and optical fiber tubes, and an electric circuit board to provide power supply to the light emitting device on each number plate causing it to send light through the optical fiber tubes for illumination.

A regular house number plate is simply a plate bearing a number or set of numbers and hung on the front side of the house. The number or set of numbers on the house number plate may be difficult to identify during the dark. Therefore, people may install a lamp to illuminate the house number plate at night or during the dark. There is disclosed a house number plate having a series of light emitting devices arranged on the front side thereof and controlled to give light for illumination. This structure of house number plate with light emitting means consumes much power supply and is difficult to maintain.

SUMMARY OF THE INVENTION

The present invention eliminates the aforesaid drawbacks. It is therefore one object of the present invention to provide a house number plate and lamp assembly which gives light no illuminate the number plates thereof during the dark. It is another object of the present invention to provide a house number plate and lamp assembly which is detachable and easy to maintain. It is still another object of the present invention to provide a house number plate and lamp assembly which consumes little electric power supply.

According to one aspect of the present invention, the house number plate and lamp assembly comprises a housing having an opening; a window plate fastened inside the housing behind the opening and having a plurality of view windows; a plurality of number plates fastened to either view window, each number plate having a plurality of small through holes made around the border of a white-colored numeral being printed on a black-colored front surface thereof, a holder frame on a back surface thereof, a light emitting device mounted on the holder frame at the top, a plurality of optical fiber tubes fastened to the holder frame at the bottom and respectively inserted in either small through hole; and an electric circuit board fastened inside the housing and controlled to provide power supply to the light emitting device on each number plate causing it to send light through the optical fiber tubes in illuminating the numeral. According to another aspect of the present invention, a photo-coupler or timer may be installed in the electric circuit board to control the operation of the light emitting device on each number plate automatically.

DETAILED DESCRIPTION OF THE PREFERRED EMBODIMENT

Figure 1:
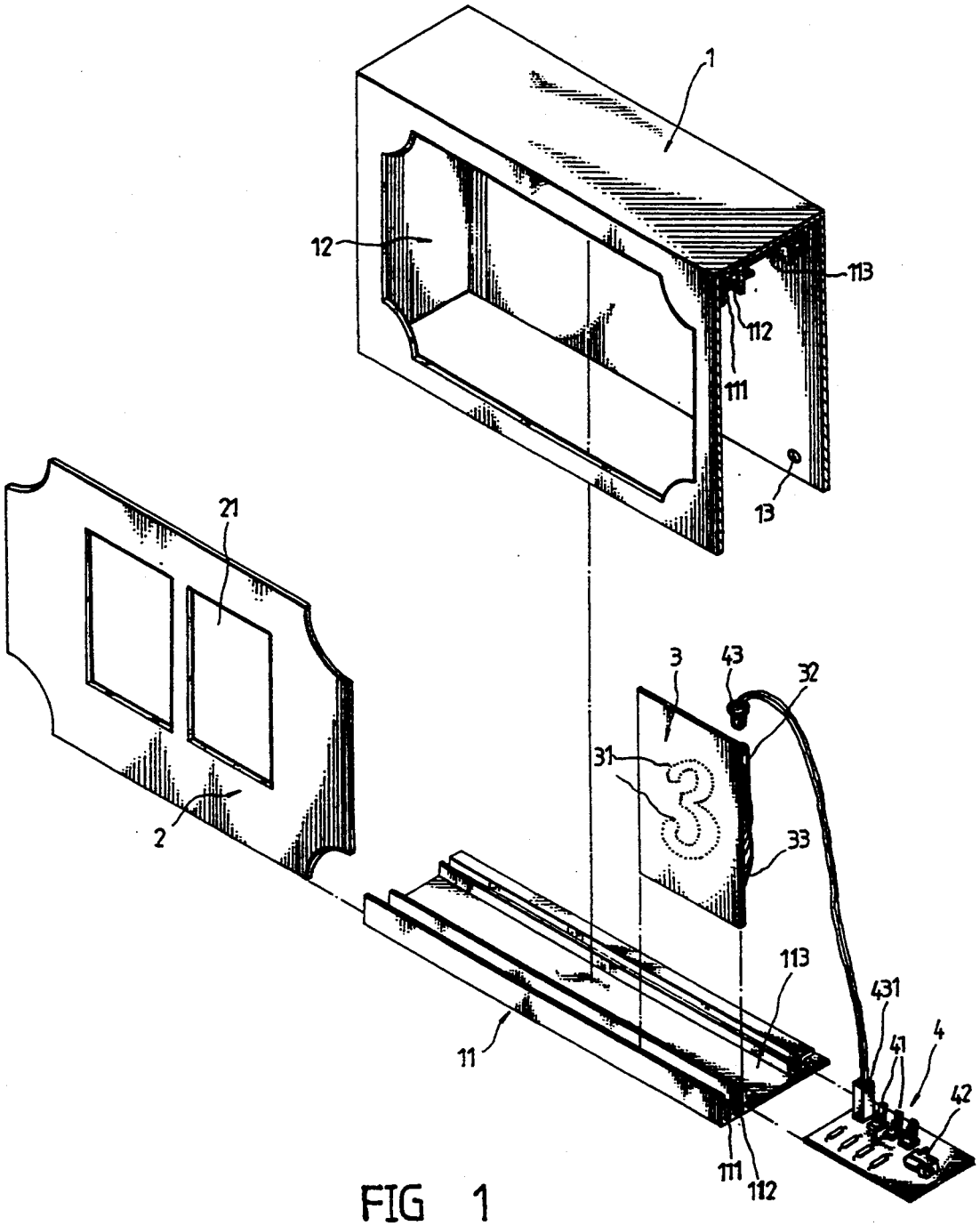
FIG. 1 is an exploded view of a house number plate and lamp assembly according to the present invention.
Figure 2:
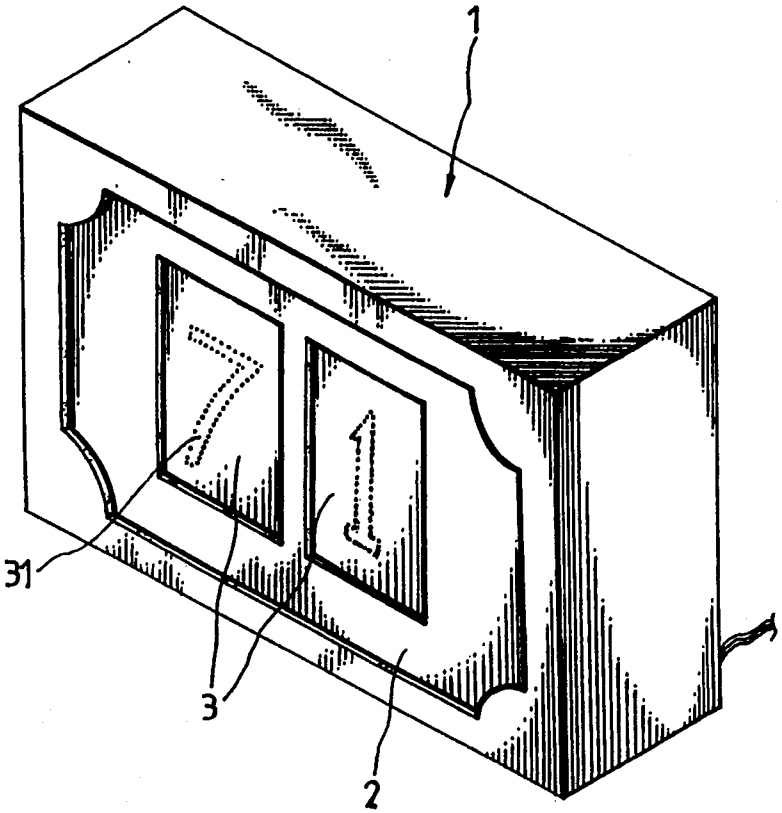
FIG. 2 is an elevational view of the house number plate and lamp assembly of the present invention.
Figure 3:
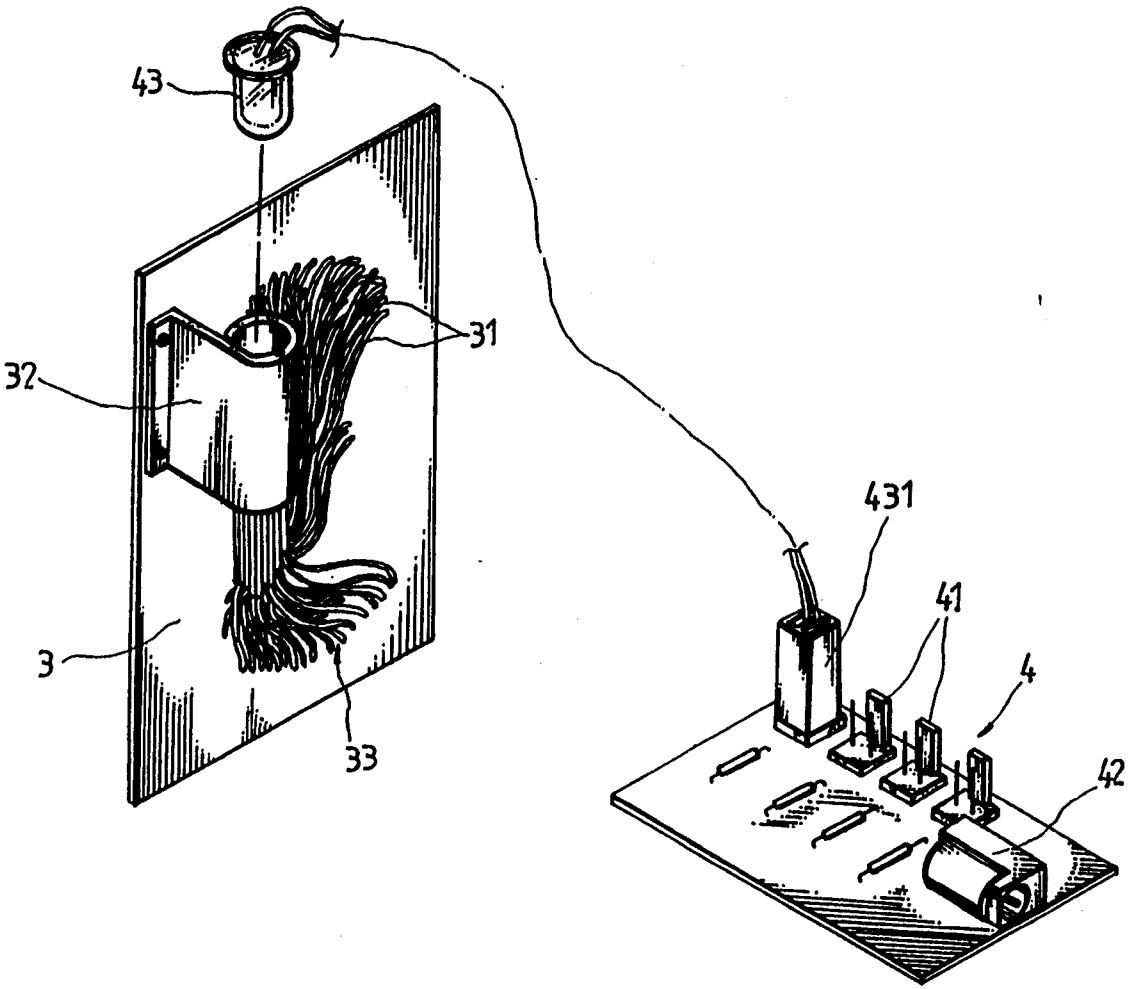
FIG. 3 shows the structure of the number plate and electric circuit board of the number plate and lamp assembly of the present invention.

Referring to FIGS. 1, 2, and 3, a house number plate and lamp assembly in accordance with the present invention is generally comprised of a housing 1, a window plate 2, a plurality of number plates 3, and an electric circuit board 4.

The housing 1 comprises a horizontal bottom plate 11. The bottom plate has two parallel sliding grooves 111;112 longitudinally disposed along the length thereof at one side, which receive the window plate 2 and the number plates respectively, and a longitudinal track 113 disposed along the length thereof in the middle, which receives the electric circuit board 4. The horizontal top wall of the housing 1 is made symmetrical to the bottom plate 11, having two parallel sliding grooves 111;112 and a longitudinal track 113. The housing 1 further comprises an opening 12 on the front panel thereof, and a wire hole 18 on the back panel thereof.

The window plate 2 is inserted in the sliding grooves 111 and covered behind the opening 12 and disposed between the horizontal bottom plate 11 and horizontal top wall of the housing 1, having a plurality of windows 21.

The number plate 3 has small through holes 31 made around the border of the white-colored numeral being printed on the black-colored front surface thereof. The back side of the number plate 3 is fastened with an holder frame 32, which holds a light emitting device (LED, lamp bulb, etc.) 43 and a plurality of optical fiber tubes 33. The optical fiber tubes 33 have a respective rear end fitted into either small through hole 31.

The electric circuit board 4 is horizontally fastened to the longitudinal track 113 on the horizontal bottom plate 11 inside the housing 1, comprising a power input terminal connected to a power supply outlet by a power cord being inserted through the wire hole 13 on the housing 1, a plurality of power output terminals 41, which receive the power input plug 431 of the light emitting device 43 being installed in either number plate 3, connected in parallel to the power input terminal 42.

Referring to FIG. 3 again, when the light emitting device 43 on each number plate 3 is respectively turned on to give light, light rays are transmitted through the optical fiber tubes 33 and projected into the air through the small through holes 33, and therefore the numeral on each number plate 3 is illuminated.

While only one embodiment of the present invention has been shown and described, it will be understood that various modifications and changes could be made without departing from the spirit and scope of the invention. For example, a photo-coupler or timer may be installed in the electric circuit board 4 to control the lightening of each light emitting device 43 automatically.

What is claimed is:

1. A house number plate and lamp assembly comprising:

a housing, which comprises a horizontal bottom panel having a first sliding groove and a second sliding groove longitudinally disposed in parallel at one side thereof and a longitudinal track longitudinally disposed in the middle, a vertical front panel having an opening, a vertical back panel, a horizontal top panel having a first sliding groove and a second sliding groove opposed to the first and second sliding grooves on said horizontal bottom panel respectively;

a window plate inserted in the first sliding grooves on said horizontal bottom and top panels and covered behind the opening on said housing, said window plate having a plurality of windows;

a plurality of number plates respectively inserted in the second sliding grooves on said horizontal bottom and top panels and disposed behind the windows on said window plate, each number plate having a plurality of small through holes made around the border of a numeral printed on a front surface thereof, a holder frame on a back surface thereof, a light emitting device mounted on said holder frame, a plurality of optical fiber tubes fastened to said holder frame and respectively inserted in said small through holes; and an electric circuit board fastened to the longitudinal track on said horizontal bottom panel inside said housing, said electric circuit board comprising a power input terminal to be connected to a power supply outlet, a plurality of power output terminals connected in parallel to said power input terminal and controlled to provide power supply to the light emitting device on either number plate.

2. The house number plate and lamp assembly of claim 1 wherein said electric circuit board further comprising a photo-coupler and a timer for controlling the operation of the light emitting device on either number plate automatically.

* * * * *